United States Patent [19]

Hyde et al.

[11] 4,147,343

[45] Apr. 3, 1979

[54] ACROBATIC AMUSEMENT DEVICE

[76] Inventors: Phillip R. Hyde, 1316 Kenwood La.; Samuel J. Lewis, 103 Grover Ct., both of Charlottesville, Va. 22901

[21] Appl. No.: 912,249

[22] Filed: Jun. 2, 1978

Related U.S. Application Data

[63] Continuation-in-part of Ser. No. 772,138, Feb. 25, 1978, abandoned.

[51] Int. Cl.[2] ..... A63G 1/12

[52] U.S. Cl. ..... 272/33 B

[58] Field of Search ..... 272/33 R, 33 B, 1 R; 280/206, 207, 208, 290; 104/77, 78

[56] References Cited

U.S. PATENT DOCUMENTS

| | | | |
|---|---|---|---|
| 352,989 | 11/1886 | Burbank | 280/207 X |
| 482,100 | 9/1892 | Rawle | 280/207 |
| 511,139 | 12/1893 | Harper | 280/206 |
| 589,249 | 8/1897 | Dornseif et al. | 280/207 |
| 591,025 | 10/1897 | Tolson | 280/207 |
| 597,843 | 1/1898 | French | 272/33 R |
| 2,403,593 | 7/1946 | Franklin | 272/33 R |
| 3,127,169 | 3/1964 | Guihan | 272/33 R |
| 3,197,202 | 7/1965 | Tieman | 272/33 R |
| 3,197,203 | 7/1965 | Tieman | 272/33 R |
| 3,260,324 | 7/1966 | Suarez | 280/206 X |
| 3,276,777 | 10/1966 | Pruitt, Sr. | 272/33 R |
| 3,298,685 | 1/1967 | Williams | 272/33 R |
| 3,371,943 | 3/1968 | Turgetto | 272/33 R |
| 3,519,268 | 7/1970 | McQueen | 272/1 R |
| 3,575,443 | 4/1971 | Aguilar | 272/33 R |
| 3,806,156 | 4/1974 | Tidwell | 272/33 R |
| 3,876,025 | 4/1975 | Green | 280/206 X |
| 3,972,527 | 8/1976 | Bacon | 272/33 R |

FOREIGN PATENT DOCUMENTS

| | | | |
|---|---|---|---|
| 1478025 | 10/1969 | Fed. Rep. of Germany | 272/33 R |
| 1292441 | 10/1972 | United Kingdom | 280/206 |

*Primary Examiner*—Richard C. Pinkham
*Assistant Examiner*—Arnold W. Kramer
*Attorney, Agent, or Firm*—Irons and Sears

[57] ABSTRACT

An acrobatic amusement device comprising an outer wheel affixed to a stationary platform. The outer wheel has a track on its inner circumference and a riding unit is supported within the outer wheel for movement relative to this track. The riding unit comprises frame members having three rotatable wheels thereon which mate with the outer wheel track at two places on one side of a diameter of the outer wheel and at one place on the other side of that diameter. The riding unit can be given a motion relative to the track and rotary within the outer wheel about an axis coincident with the axis of that wheel to provide amusement and thrill for an occupant sitting upon the riding unit. A locking device may be provided to hold the riding unit in fixed relationship with respect to the outer wheel to allow the rider to mount and dismount from the riding unit, and a seat belt may be provided which must be fastened before the locking device will release.

10 Claims, 7 Drawing Figures

ACROBATIC AMUSEMENT DEVICE

This invention relates generally to an acrobatic amusement device fixed stationary with respect to the ground, and more particularly, to a device having a riding unit mounted for rotation with respect to an outer wheel wherein a person sitting on the riding unit can rotate himself within the outer wheel.

The prior art contains a substantial number of rolling vehicular toys which comprise tumbling wheels where an occupant can sit within the wheel and roll rather freely about whatever surface on which the wheel rests. U.S. Pat. Nos. 3,371,943; 3,575,443; and, 3,806,156 are examples of such prior art devices. In U.S. Pat. No. 3,575,443, there is an inner frame which the rider can hold in a given position while the outer frame is rolling upon the surface upon which the entire device rests. U.S. Pat. No. 3,806,156 discloses an inflatable device to be used as a rolling toy.

U.S. Pat. No. 3,197,202 and 3,197,203 are similar to the rolling type devices; however, U.S. Pat. No. 3,197,202 discloses a device which rolls on the surface in a radius about a fixed center. The device illustrated in FIG. 10 is of interest in that a passenger seat is provided which rotates with the rider of the vehicle, who is mounted within the single wheel which rotates about the center. In this device, the occupant or rider moves the wheel with his body weight. U.S. Pat. No. 3,197,202 illustrates a device in which the rider merely rotates the wheel which is mounted stationary with respect to the ground. Another similar device is illustrated in U.S. Pat. No. 3,127,169 where a rotating swing for carrying two people is disclosed.

Further, a number of motorized unicycles in which the rider is mounted within an outer wheel are known. Such devices are illustrated by U.S. Pat. Nos. 511,139; 3,260,324; and, 3,876,025. A similar device having two wheels is illustrated in U.S. Pat. No. 3,183,020. In these devices, the rider sits within the wheel of the unicycle. U.S. Pat. No. 511,139 illustrates a pedal means for providing motive power. A motorized unicycle is illustrated by U.S. Pat. No. 3,260,324 and a propeller provides the motive power in the device of U.S. Pat. No. 3,876,025. Although it can be appreciated that each of the above-described prior art devices have distinctive advantages, they do not provide an acrobatic amusement device such as described below.

SUMMARY OF THE INVENTION

The present invention is directed to an acrobatic amusement device in which the rider of the device can propel himself around a circle having a defined radius in a plane generally vertical with respect to the ground. In this device, the rider can go forward or backward, in a rocking motion, or can do a loop either forward or backward to provide amusement and thrill. Thus, there is provided an amusement device which will provide long hours of active entertainment for children and adults alike. If desired, the device can be motorized or made toy-size, in which case the rider would be a doll figure.

Accordingly, it is a primary object of the present invention to provide an amusement device which is relatively stable in operation and will provide its rider a source of amusement and thrill.

Another object of the present invention is to provide an amusement device which is capable of permitting a rider to move clockwise and counterclockwise about a circle arranged in a vertical plane in a manner controlled by him, both as to direction and speed, which device is stable and stationary with respect to the surface upon which it rests.

A further object of the present invention is to provide an improved amusement device and ride that is simple to manufacture and economical but one which still provides a thrilling, safe experience for the rider.

These and other objects, features and advantages of the present invention will be more fully realized and understood by the following detailed description, when taken in conjunction with the accompanying drawings, wherein:

BRIEF DESCRIPTION OF THE DRAWINGS

Like reference numerals throughout the various views of the drawings are intended to designate the same elements.

DETAILED DESCRIPTION OF THE PREFERRED EMBODIMENT

Figure 1:
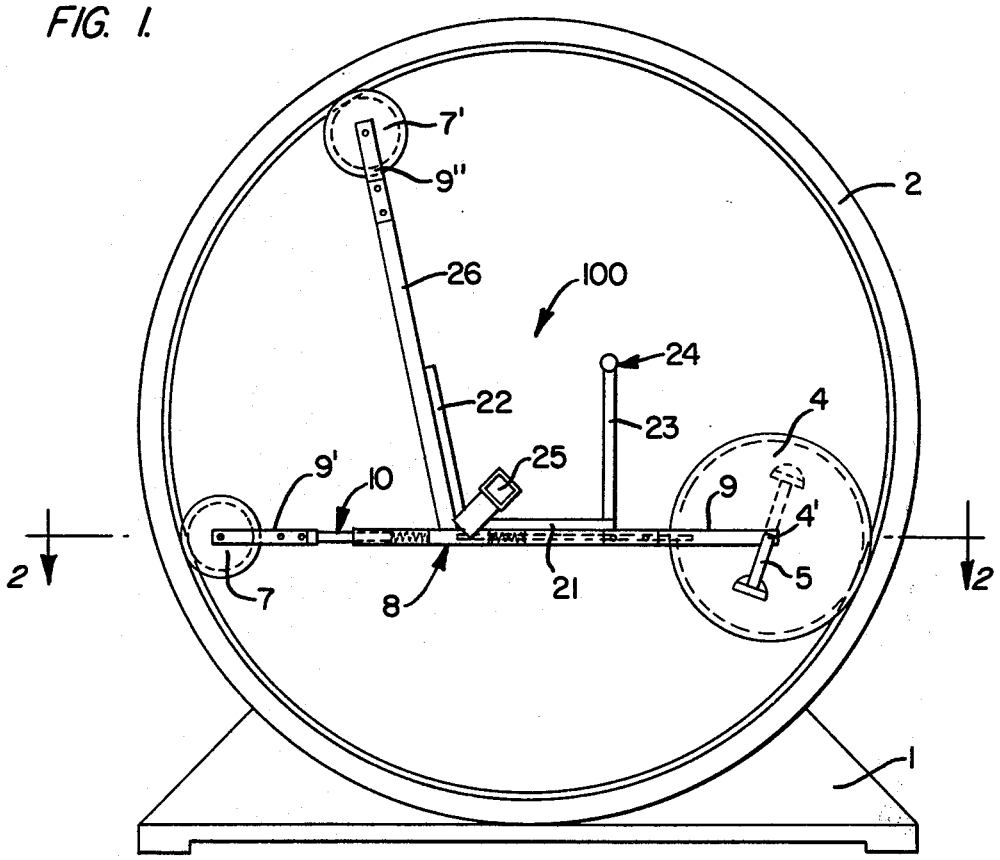
FIG. 1 is a diagrammatic side elevation view of an amusement device constructed in accordance with the principles of the present invention.
Figure 4A:
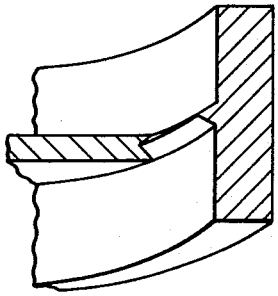
FIGS. 4*a, b, c* and *d* illustrate four alternative track constructions for use in the device of FIG. 1.
Figure 4B:
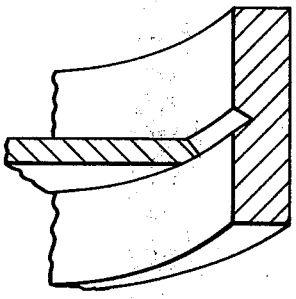
Figure 4C:
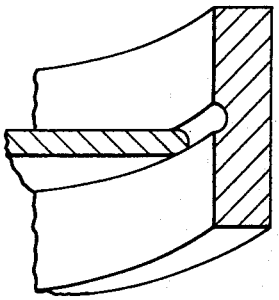
Figure 4D:
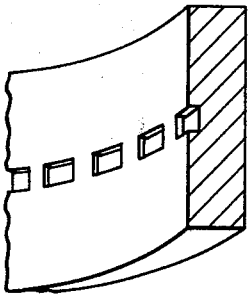
Figure 2:
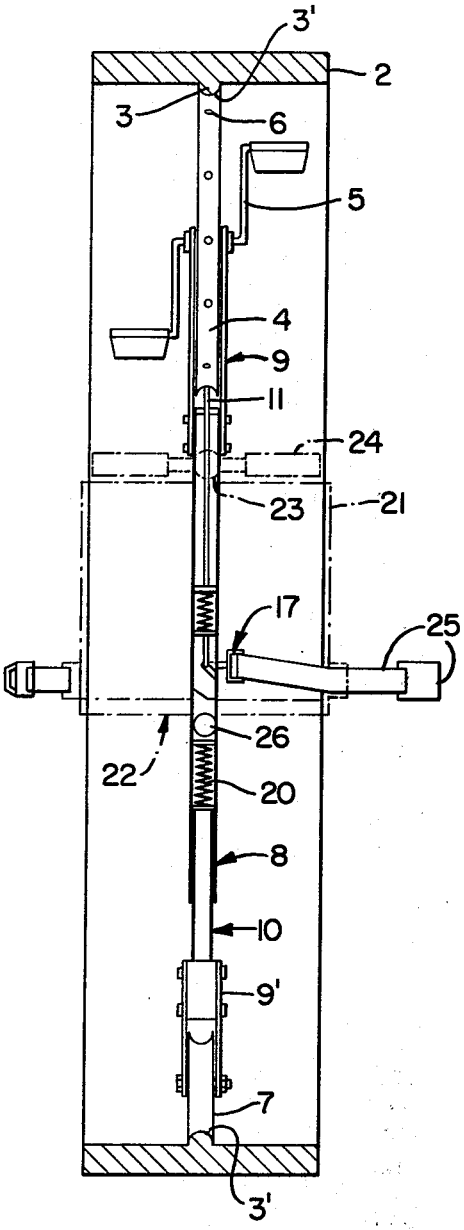
FIG. 2 is a sectional view of the device illustrated in FIG. 1 taken along section line 2—2.

With reference to FIG. 1 of the drawings, there is diagrammatically shown an acrobatic amusement device in accordance with the principles of the present invention. The device comprises a base platform 1 supporting an outer wheel 2, and a riding unit, generally designated by the numeral 100. A raised track 3, which can be a radius track as illustrated in FIG. 2, or a v-track, as illustrated in FIG. 4*a*, is provided around the inner circumference of outer wheel 2. Recessed tracks such as illustrated in FIGS. 4*b*, 4*c* and 4*d* are also suitable. Riding unit 100 is mounted within the outer wheel 2 for movement in rotary fashion around the interior of wheel 2. The riding unit 100 comprises a main support shaft 8, pedal wheel 4, and tracking wheels 7, 7'. A seat 21, supported on main support shaft 8, is provided for the rider. The pedal wheel 4 and tracking wheels 7, 7' each have means which mate with the track 3 or groove on wheel 2, such as radius groove 3' which mates with radius track 3. The grooves 3' and the construction of, for example, tracking wheel 7 keep the riding unit 100 securely within the outer wheel 2 as the riding unit moves in a circular fashion on track 3. The riding unit is propelled by pedals 5 in this embodiment; however, the unit can be motorized, e.g., by a battery-operated electric motor a spring-operated motor, within the scope of this invention.

Figure 3:
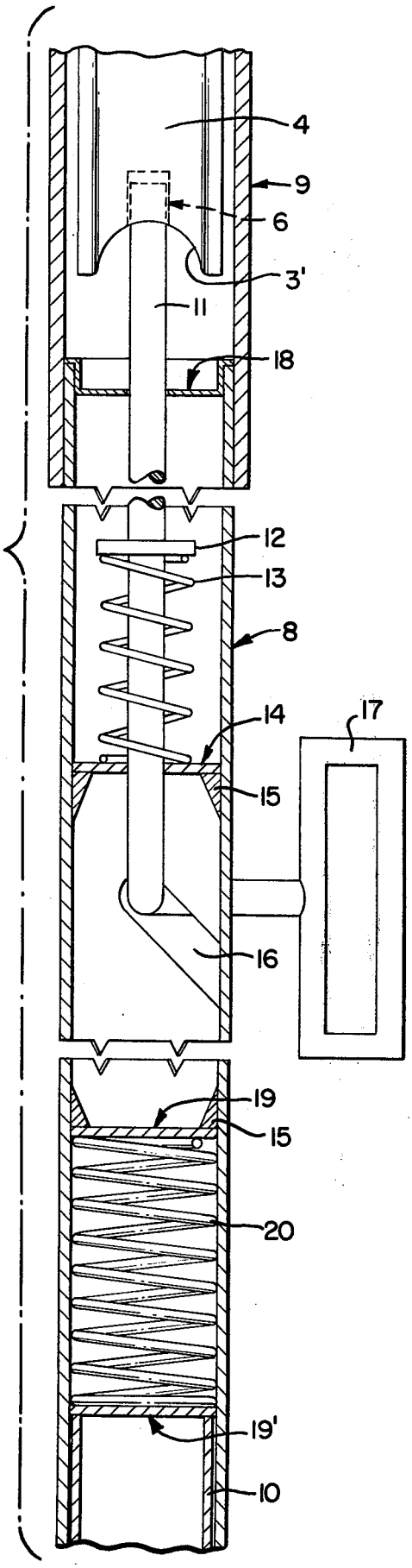
FIG. 3 is a detailed view of a portion of the sectional view of FIG. 2 illustrating the locking mechanism for the drive wheel and mounting for the tracking wheel.

Shaft 8 comprises a tubular, or similar shaft which contains the mechanism holding pedal wheel 4 and the tracking wheels 7, 7'. As best illustrated in FIGS. 2 and 3, the axes for drive wheel 4 and tracking wheel 7 are in the same horizontal plane as shaft 8 and wheel 7 is spring-loaded to press against outer wheel 2 and thereby also to press drive wheel 4 against outer wheel 2. Both drive wheel 4 and tracking wheel 7 have a groove 3', or a raised track, to match the raised track 3, or groove, in the outer wheel 2. If desired, drive wheel 4 and tracking wheel 7′ can be spring-loaded. Drive wheel 4, as shown, is a pedal wheel having standard pedals 5, with, if desired, toe keepers, as illustrated. Other mechanisms driving the device can be used as desired, including an electrically-driven drive wheel or a spring-driven drive wheel. Drive wheel 4 is mounted on connecting bracket 9 for rotation about an axis 4′. Bracket 9 is secured to one end of the main shaft 8, e.g., by welding. An adjustable sleeve 10 fits over, or within, the other end of main shaft 8 and slides with respect to shaft 8. Tracking wheel 7 is rotatably mounted on sleeve 10 by connecting brackets 9′ which are secured to sleeve 10. Stop washer 19 is fixed within main shaft 8 and stop washer 19′ is fixed to the end of sleeve 10 within shaft 8. Spring 20 is placed within main shaft 8 and bears against stop washers 19 and 19′ to exert a force which tends to push sleeve 10 out of main shaft 8. Thus, spring 20 can force tracking wheel 7 against outer wheel 2 through sleeve 10 when the riding unit is in place. Spring 20 in this way exerts a force upon both tracking wheel 7 and pedal wheel 4 to keep these wheels pressed on track 3 of outer wheel 2. Top tracking wheel 7′ is also provided to securely hold the riding unit 100 within outer wheel 2. Top tracking wheel 7′ is supported upon brackets 9″ which are attached to a secondary support shaft 26. Secondary support shaft 26 is fixedly secured to main support shaft 8, preferably to the rear of the seat 21. If desired, brackets 9″ can be secured to the secondary support shaft 26 through a spring-loaded sleeve, such as sleeve 10.

As best shown in FIG. 3, drive wheel 4 is provided with a locking mechanism so that a rider may mount and dismount from the riding unit 100 with safety. This locking mechanism is operated by a seatbelt 25 provided for the rider's use. Drive wheel 4 has a number of locking holes 6 in the groove 3′ which rides against the raised track 3 of outer wheel 2. Locking holes 6 are, for example, evenly spaced about the circumference of this groove 3′. A locking rod 11 is slidably arranged inside of main shaft 8 and is adapted to be inserted into and removed from locking holes 6. Locking rod 11 is slidably supported within main support shaft 8 by stop washer 14 and guide 18 which are secured within shaft 8 and have holes through which rod 11 passed. A stop washer 12 is attached to, e.g., welded to locking rod 11 and a spring 13 is arranged between locking washer 14 and locking washer 12 to normally force locking rod 11 in a locking hole 6 when the seatbelt is unattached. A seatbelt bracket 17 is fixedly secured to locking rod 11 through a slot 16 in the main shaft 8. The slot is arranged so that upon pulling of seatbelt bracket 17, locking rod 11 is pulled against the force of spring 13 and out of locking hole 6, so that drive wheel 4 is free to turn. A seatbelt 25 is attached to the seatbelt bracket 17.

Seat bottom 21 is attached to main shaft 8. Seat back 22 is attached to seat bottom 21 for comfort and is supported by secondary shaft 26. For comfort and safety, safety handle support 23 supports a safety handle 24 which is connected to main shaft 8. Safety handle 24 can be provided with plastic grips, as desired.

In operation, the rider seats himself upon seat 21 and buckles safety belt 25. In buckling safety belt 25, the rider exerts a force upon seat belt bracket 17, thereby pulling locking rod 11 and releasing it from engagement with locking hole 6. This permits rotation of the drive wheel 4. The rider may then pedal the riding unit 100 and drive it along track 3 on outer wheel 2. Motion may be either forward or backward, at the will of the rider, through proper manipulation of pedals 5.

It is claimed:

1. An acrobatic amusement device comprising a stationary platform; an outer wheel affixed to said platform, said outer wheel having a circular track on its inner circumference; and a riding unit within the outer wheel arranged for movement relative to said track comprising a frame, seat means on said frame, three rotatable wheels mounted on said frame, each including complementary track means which mate with the outer wheel track, and means operably connected to one of said rotatable wheels to make it a drive wheel for propelling the riding unit relative to the track within the outer wheel to provide amusement and thrill for an occupant sitting upon the riding unit, said rotatable wheels being so positioned relative to a diameter of the outer wheel that the areas of contact of two of them with said track lie on one side of said diameter and the area of contact of one of them with said track lies on the other side of said diameter, whereby said rotatable wheels by their contact with the inner surface of said track (1) cause the motion of said frame relative to said outer wheel to be rotary about an axis coincident with the axis of said outer wheel and (2) provide support for said frame relative to said outer wheel in all positions of mutual rotational orientations.

2. The device of claim 1 further including holding means for holding the riding unit against movement relative to the outer wheel to allow the rider to mount and dismount from the riding unit.

3. The device of claim 2 further including seat belt means on said seat means having an engaged and a disengaged position, and wherein said holding means is operated by said seat belt means to release said holding means and allow movement of the riding unit upon engagement of said seat belt means.

4. The device of claim 3 wherein said holding means comprises a locking rod slidably supported on said frame means, holes in said drive wheel and means normally forcing said locking rod into one of said holes when said seat belt is disengaged, said seat belt means being connected to said locking rod to move said locking rod out of said hole upon engagement thereof.

5. The device of claim 1 further including slidable means slidably supported on said frame and supporting a rotatable wheel not a drive wheel and adjustment means adapted to normally force said slidable means on said frame in a direction to hold said last-mentioned rotatable wheel against said outer wheel.

6. The device of claim 5 further including holding means for holding the riding unit against movement relative to the outer wheel to allow the rider to mount and dismount from the riding unit.

7. The device of claim 6 further including seat belt means on said seat means having an engaged and disengaged position and wherein said holding means is operated by said seat belt means to release said holding means and allow movement of the riding unit upon engagement of said seat belt means.

8. The device of claim 7 wherein said holding means comprises a locking rod slidably supported on said frame means, holes in said drive wheel and means normally forcing said locking rod into one of said holes when said seat belt means is disengaged, said seat belt means being connected to said locking rod to move said locking rod out of said hole upon engagement thereof.

9. An acrobatic amusement device comprising a stationary platform; an outer wheel supported on said stationary platform, said outer wheel having a track on its inner circumference; and a riding unit supported within the outer wheel for movement around said track, said riding unit comprising a frame, seat means on said frame, at least one rotatable tracking wheel mounted on said frame including track means which mate with the outer wheel track, motive means including a rotatable drive wheel for propelling the riding unit around the track within the outer wheel to provide amusement and thrill for an occupant sitting upon the riding unit, seat belt means on said seat means having an engaged and disengaged position, and holding means for holding the riding unit in fixed relationship with respect to the outer wheel without movement of the riding unit to allow the rider to mount and dismount from the riding unit comprising a locking rod slidably supported on said frame, holes in said drive wheel and means normally forcing said locking rod into one of said holes when said seat belt is disengaged, said seat belt means being connected to said locking rod to move said locking rod out of said hole upon engagement thereof.

10. An acrobatic amusement device comprising a stationary platform; an outer wheel supported on said stationary platform, said outer wheel having a track on its inner circumference; and a riding unit supported within the outer wheel for movement around said track, said riding unit comprising a frame, seat means on said frame, two rotatable tracking wheels mounted on said frame including track means which mate with the outer wheel track, and motive means including a rotatable drive wheel for propelling the riding unit around the track within the outer wheel to provide amusement and thrill for an occupant sitting upon the riding unit, means for pressing one of said rotatable tracking wheels of the riding unit against the outer wheel to retain said track means of said rotatable tracking wheel in engagement with said track of the outer wheel comprising slidable means slidably supported on said frame and supporting said last-mentioned rotatable tracking wheel and spring means adapted to normally force said slidable means on said frame in a direction to hold said last-mentioned rotatable tracking wheel against said outer wheel, holding means for holding the riding unit in fixed relationship with respect to the outer wheel without movement of the riding unit to allow the rider to mount and dismount from the riding unit, and seat belt means on said seat means having an engaged and disengaged position, said holding means being operated by said seat belt means to release said holding means and allow movement of the riding unit upon engagement of said seat belt means and comprising a locking rod slidably supported on said frame means, holes in said drive wheel and means normally forcing said locking rod into one of said holes when said seat belt is disengaged, said seat belt means being connected to said locking rods to move said locking rod out of said hole upon engagement thereof.

* * * * *

UNITED STATES PATENT OFFICE

CERTIFICATE OF CORRECTION

Patent No. 4,147,343 Dated April 3, 1979

Inventor(s) Phillip R. Hyde and Samuel J. Lewis

It is certified that error appears in the above-identified patent and that said Letters Patent are hereby corrected as shown below:

Column 1, line 29, "3,197,202" should read --3,197,203--;

Column 2, line 57, "motor a spring-operated" should read --motor or a spring-operated--;

Column 4, line 57, "engaged and disen-" should read --engaged and a disen- --;

Column 5, line 13, "engaged and" should read --engaged and a--;

Column 6, line 19, "engaged and disengaged" should read --engaged and a disengaged--.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*